United States Patent [19]

Nakata

[11] 4,196,768

[45] Apr. 8, 1980

[54] CASTING MOLD MANUFACTURING PROCESS AND APPARATUS THEREFOR

[75] Inventor: Kunii Nakata, Nagano, Japan

[73] Assignee: Yamato Manufacturing Co., Ltd., Matsumoto, Japan

[21] Appl. No.: 821,757

[22] Filed: Aug. 4, 1977

[51] Int. Cl.[2] ..... B22C 9/02

[52] U.S. Cl. ..... 164/15; 164/7; 164/41; 164/186

[58] Field of Search ..... 164/7, 12, 41, 16, 192, 164/193, 186, 15, 6, 200; 366/22, 64

[56] References Cited

U.S. PATENT DOCUMENTS

| | | | |
|---|---|---|---|
| 1,546,335 | 7/1925 | Browne | 366/64 X |
| 2,041,721 | 5/1936 | Norton | 164/5 X |
| 2,471,964 | 5/1949 | Kissalt | 164/12 X |

FOREIGN PATENT DOCUMENTS

| | | | |
|---|---|---|---|
| 2311795 | 3/1973 | Fed. Rep. of Germany | 164/43 |
| 2451787 | 10/1974 | Fed. Rep. of Germany | 164/41 |
| 22-29098 | 7/1947 | Japan | 164/7 |
| 1403781 | 8/1975 | United Kingdom | 164/41 |

*Primary Examiner*—Richard B. Lazarus
*Assistant Examiner*—John S. Brown
*Attorney, Agent, or Firm*—J. Harold Nissen

[57] ABSTRACT

A casting mold manufacturing process and apparatus, which sand of the mold contains water-soluble paste of binder. The sand is previously heated in a sand storage tank by micro-wave heating or high frequency. The sand temperature and humidity, and volume of the binder contained in the sand are freely controlled. The preheated sand is blown by a preheated air to supply it to a molding flask placed under the storage tank. The preheated air is controlled in its humidity and warmness.

2 Claims, 11 Drawing Figures

CASTING MOLD MANUFACTURING PROCESS AND APPARATUS THEREFOR

This invention relates to a casting mold manufacturing method, and more particularly to a mold manufacturing method in which a water-soluble paste is used as a binder of molding sand in order to obtain a moldings which is later dried and solidified for a short time during mold forming time.

Water-soluble paste binder has been used to molding sand for a long time.

Molding sand containing the paste binder is easy to separate from the casting mold and from the castings, so that fine and smooth casting surface is advantageously obtained. Also, the molding sand can be completely and economically reused.

However, the binder paste has several shortcomings such as a long time until the molding sand containing the binder paste is dried and solidified, bad formability or sustainability of the mold containing the conventional paste and accordingly bad handling character, deterioration of the binder when leaving as it is for a long time duration. In particular, the binder of starch paste has still another shortcoming, it contains rather large volume of water. According to the prior art, at the usual condition, the mold employing the starch binder contains 6 to 8% of water contents. Therefore, a time duration of 2 to 3 hours are disadvantageously spent from the time of completion of shaping a casting mold weighed 5 kg to the time of completion of drying and solidifying it. The turnover efficiency of the mold such as a wooden pattern and a core becomes very bad. A forming speed of the mold is slow, so that the mold apt to break loose during the process Amylase contained in the starch paste deteriorates even in a room temperature and the tackiness of the paste is lowered with the lapse of time. As a result the conventional binder is practically not emplyed at present.

There are many kinds of the casting mold manufacturing method using no binder paste of the prior art, such as so called $CO_2$ process, a shell mold process and a cementing mold process.

In the $CO_2$ process, about 4% of sodium silicate (water glass) is mixed to siliceous sand to shape or form the mold and then carbonic acid gas is blowed into the mold to solidify it for a very short time. According to the shell mold process, a mixture of siliceous sand powder and thermosetting resin is used to cover a model in order to manufacture a casting mold. In accordance with other processes, chemically setting resin and cement etc. are used to obtain a mold.

Also, the conventional processes for shaping mold have many shortcomings. The sand employed in the process using carbonic acid gas or any cement is not reused, so that it is not economical. In the process using any resin such as shell mold process, bad smell is generated from phenol resin during pouring process. In order to reuse the molding of shell mold process, it is necessary to treat it completely. Furthermore, cost of the resin is rather high and the design of the casting mold is very difficult. In particular large volume of waste sand is produced by $CO_2$ process in which toxic carbonic acid gas is used. Free alkali is contained in the waste sand and the sand is lumped by burning, becoming nonreusing of it. Massed waste sand may become a social problem of environment pollution.

The inventor comes to a conclusion that the conventional water-soluble paste binder is better when its shortcomings such as a long time until the casting mold containing the paste is dried and solidified, bad formability or sustainability of the mold containing the paste, easy deterioration of the binder, and large volume of water contained in mold are all completely solved.

Accordingly, the primary object of the present invention is to provide a novel and improved manufacturing method of a casting mold for rapidly drying and solidifying the mold containing the water-soluble paste binder.

Another object of the present invention is to provide a novel and improved manufacturing method of casting mold, including the steps of swiftly drying the binder mixed and kneaded sand and solidifying the mold of the sand.

Still another object of the present invention is to provide a new and improved manufacturing method of a casting mold, which including the steps of dielectric heating, hot air blowing or negative pressure evaporation of sand during shaping of the mold.

Still another object of the present invention is to provide a new and improved manufacturing method of a casting mold, which employing a principle of forcibly drying during mold shaping process and a principle of aqueous vapor transmission to lower the steam pressure in the mold sand.

Still another object is to provide a apparatus for effectively carrying out the improved manufacturing method of a casting mold.

Another objects and advantages of the present invention will be apparent from the following description.

According to the present invention, some of wheat flour, corn flour, starch and dextrine are mixed to produce water-soluble paste, which paste is mixed with molding sand and the mixed material is kneaded sufficiently. Then the mixed and kneaded material of sand and paste is filled in a wooden pattern or model having a core to produce a casting mold, and the mold is microwave or high frequency dielectrically heated. As known, in the system of micro-wave heating, the molecules of the material to be heated are vibrated and thus heat is generated from its inner portion. The whole portion of the material such as the casting mold is heated uniformaly and thoroughly for a very short time. The water contained in the casting mold is easily heated to its evaporating temperature by the high frequency dielectrically heating process.

In order to transfer the evaporated vapor to the outside of the mold, lower the steam pressure on the surface from which the vapor rises, and accelerate or continue the evaporation, the mold is heated by hot air blowing. Hot air of about 200° C. forcebly blows into the mold. A suction blower may be installed at the outlet side of the mold in order to accelerate the drying efficiency. By using a orifice effect of making thin the air stream, suction phenomenon or constant negative pressure is generated and thus the drying of the mold is accelerated. A controlable device may be employed to reciprocally apply heating and negative pressing to the casting mold. When warm air stream is employed to the mold, its water content may be condensed on the air passage and prevent the air stream from smooth flowing.

The water content in the binder paste is made to 100° C. by radically heating the mold under pressure, instantaneously a negative pressure condition is applied to the mold, and thus the water content in the mold is for a short time gasified and the mold is wholly dried.

In order to carry out more effectively the forced drying process of the casting mold, the mixed and kneaded sand with water-soluble paste is previously stored in a storage tank, the sand in the tank is constantly kept at its warmed condition by a heating process such as micro-wave or high-frequency dielectric heating and hot steam. When the modeling process of the casting mold starts, a suitable volume of the sand is taken out from the tank and at once dropped into the shaping pattern in order to shorten the time duration in which the casting sand rises its temperature to the water evaporating temperature. If the casting sand is not raised previously its temperature, the portion of low temperature and the portion of high temperature are made within the sand during the heating and drying process, so that only the water content in the low temperature portion is condensed and the air flowing is obstructed, and as a result the water condensed portion remains undried. When particular kind of the paste binder and the condition of the pattern are suitably selected, the sand is preheated over 100° C. under pressure and accordingly the water content in sand is instantaneously dried. Because the mixed and kneaded molding sand is stored in a separate container and preheated by a suitable heating means, the drying and solidifying time of the casting mold is exceedingly shortened, and as well as deterioration of the paste binder is prevented from occurring within the container. According to the experience, the starch paste preserves for a long time its tackiness when a suitable water content and a suitable temperature are applied thereto.

In order to further increase the tackiness of the binder paste, a small quality of caustic soda solution is previously decomposed compositions such as dextrin and sugar originally placed in the binder paste in a mixed condition.

The details of the effectiveness of the binder paste will be apparent from the following description with respective to examples or experiments.

EXAMPLE 1

Corn starch was poured into water and boiled to make starch paste 5% of weight ratio of the starch paste was added to No. 6 siliceous sand and kneaded. The mixed and kneaded starch and sand was immediately placed into a preheater tank and heated to 110° C. by super-heated steam. The sand and starch rapidly filled to a molding core flask of 50 mm×50 mm in order to make formations or moldings. In order to rapidly dry the formations, hot air wind of 200° C. was sucked into an end of the core flask by means of a vacuum pump. The moldings according to the process was compared with another moldings conventionally formed at a normal temperature and dried in a drying furnace in their strength and drying time as shown in Table 1. As apparently shown in Table 1, the moldings made according to the present invention was superior to those of the prior art.

Table 1

| | Normal tem. molding then dried at 200° C. furnace | High temp. molding, air blowing dried at 200° C. |
|---|---|---|
| Time until drying completion resistance | 90 sec. | 5 sec. |

Table 1-continued

| | Normal tem. molding then dried at 200° C. furnace | High temp. molding, air blowing dried at 200° C. |
|---|---|---|
| pressure kg/cm$^2$ | 7.1 | 14.4 |

EXAMPLE 2

20% of corn starch was added to 1% caustic soda solution and boiled to obtain paste. The paste of 5% was mixed to molding sand and kneaded. The mixed and keaded sand was placed in a micro-wave preheating tank to heat it to 90° C. At once the hot sand was filled into the core flask of 28 mm×50 mm, preventing the sand from temperature-dropping. The formations or moldings were heated and dried under pressure with hot air blowing at temperature of 200° C. The molding of the present invention was compared with another molding conventionally formed at a normal temperature and dried in air flowing in their strength and drying time in Table 2.

Table 2

| | Normal temp. molding dried by air blowing, 200° C. | High temp. molding dried by air blowing; 200° C. |
|---|---|---|
| Time until drying completion | 9 sec. | 4 sec. |
| pressure resistance kg/cm$^2$ | 9.7 | 17.2 |

EXAMPLE 3

5% of water-soluble poval was added to water to completely dissolve poval. 5% of potato starch was added to the poval solution and was kneaded to make paste. 5% of the paste was added to and kneaded with 5% of No. 6 siliceous sand. Immediately, the kneaded sand was entered to a preheater to heat it by high frequency process to 95° C. The sand was rapidly blown by superheated steam and filled into a core flask or 28 mm×50 mm and finally placed in a furnace of 110° C. in order to solidify the moldings of sand.

As apparently shown in Table 3 comparing the moldings of the present invention with the another formed at normal temperature, high temperature process was advantageously carried out on the water-soluble poval of paste binder.

Table 3

| | Normal temp. molding, dried in furnace at 110° C. | High temp. molding, dried in 110° C. furnace |
|---|---|---|
| Time until drying completion | 25 sec, | 15 sec. |
| pressure resistance kg/cm$^2$ | 7 | 15 |

EXAMPLE 4

5% of starch paste containing 80% water was added to and kneaded with molding sand and the resultant sand was stored in a preheating and warm keeping tank, steam-heating to 100° C. The sand was rapidly filled into a core flask sizing 50 mm×50 mm and immediately placed in a vacuum tank to rapidly heat the sand molding by micro wave under developing negative pressure. Therefore, heating time was made shortened to 5 second and it was shorter than that of conventional one by over 10 times.

EXAMPLE 5

100 parts of No. 6 siliceous sand and 5 parts of starch paste containing water of 80% were mixed and kneaded and the resultant sand was placed into a preheater tank. Super-heated steam was blown into the tank to warm the sand to 100° C. and it was rapidly filled into a core flask by using super-heated steam, producing a casting mold of 5 kg. Immediately the casting mold was entered a pressure tank and super-heated steam was supplied thereto until two degree of atmospheric pressure was obtained. When an inner portion of the casting mold was heated sufficiently, the pressure of the inner portion was rapidly lowered to −60 mm hg by means of a vacuum pump. By carrying out the steps mentioned above several times, even the inner portion of the mold was completely dried for a short time, obtaining a practical and strong core molding.

As apparent from the description an examples above, according to the casting mold manufacturing method using a water-soluble paste binder, the drying time is exceedingly shortened, and therefore the working efficiency is greatly developed and the turnover efficiency of the forming pattern such as a wooden core flask is also increased. Also, owing to micro wave heating of casting mold in vacuum atmosphere, the evaporation temperature of water is made low, preventing the shaping or forming patterns of plastics from deforming.

Furthermore, as sand-reusing progresses, paste binder contained in the core molding sand is mixed into the majority molding snad to economically strengthen its shapability. Because a smell is not generated, working environment is advantageously developed and social problem of a bad smell and alkalidistribution is effectively solved.

The embodiments of a casting mold manufacturing method and an apparatus therefor will be described taken in conjunction with the accompanying drawings in which.

Figure 1:
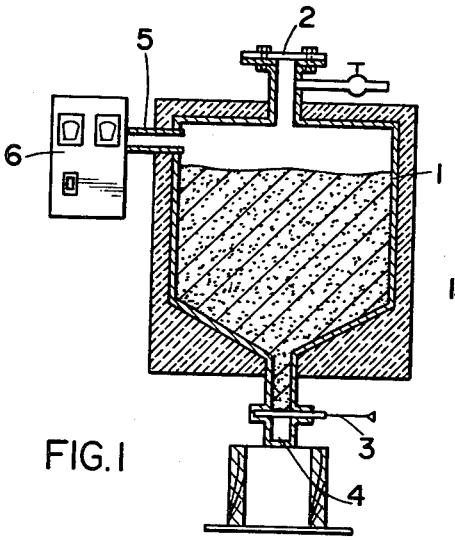
FIG. 1 shows a preheater of micro wave dielectric heating.

The mixed and kneaded sand with binder paste is stored and preheated in a preheating tank 1 shown in FIG. 1. The construction and metal material of the tank is selected according to a heating means employed. Open, semiopen or sealed type tank may be used as a preheated tank.

Figure 2:
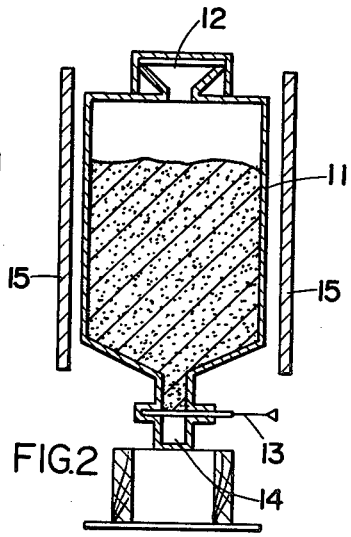
FIG. 2 is a view of another preheater of high frequency dielectric heating.
Figure 3:
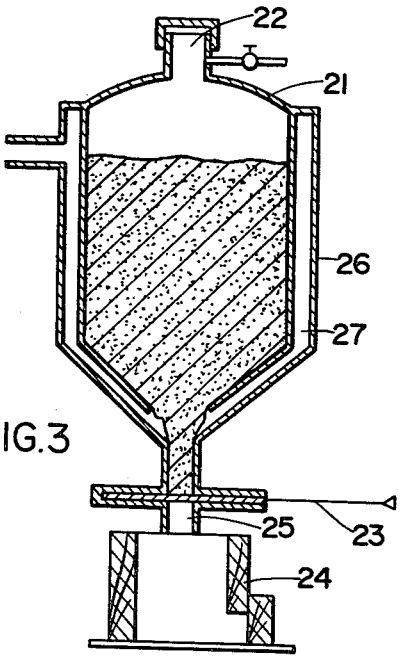
FIG. 3 is a preheater of super heated steam.

In the sealed metal tank 1, micro wave dielectric heating system is employed therein and a thermal insulator is applied around the metal tank. A mixed and kneaded sand inlet 2 is formed on the top of the tank 1, a sand outlet 4 is made at the bottom of the tank 1, which outlet 4 is led to a molding flask through a partition board 3, and a micro wave generator 6 is installed at a side of the tank 1 with a wave guide 5. The case in which a high frequency dielectric heating process is employed is shown in FIG. 2. A plastic sealed tank 11 has a mixed and kneaded sand inlet 12 fixed at its top. A sand outlet 14 is operatively opened at the bottom of the tank 11 through a partition 13 and two high frequency oscillator plates 15 are separately installed at both the sides of the tank 11. In order to use super-heated steam, a double-walled tank as shown in FIG. 3 is employed. A mixed and kneaded sand inlet or steam outlet 22 is installed on the top of an inner tank 21 of the double-walled tank. An outer tank 26 has a sand outlet 25 at its bottom, which is led to a mold shaping box 24 through a partition 23. The inner tank 21 has opened bottom led to the sand outlet 25. The super-heated steam is led into the super-heated steam passage 27 formed between the walls of the inner tank 21 and the outer tank 26 and the steam enters a space of the inner tank 21 to warm the sand contained in the space and emerges from the steam outlet 22.

If necessary, an agitator may be installed in the respective preheating tanks shown above in order to knead and uniformly warm the sand therein. It is understood that the primary function of the preheating and storing tank is to provide at all times a volume of molding sand having a fixed water content and a temperature and accordingly any type of the tank can be employed provided that it has the primary function. According to the present invention, the molding sand constantly is preheated and stored at about an evaporation temperature of water and at necessary rapidly filled or supplied to a mold shaping box by a suitable volume. As a result, the sand containing a fixed water content and having uniform and fixed temperature can be filled in the mold shaping box, so that these are eliminated that the heating time necessary to raise the temperature of sand to evaporation temperature of the water content, and drying air passage clogging owing to water condensation at the lower temperature portion of the sand mold. According to the present invention, the binder paste is constantly held in the preheating tank as its fixed temperature so as to contain a fixed volume of water, thereby no deterioration is happened on the paste.

Owing to the high temperature condition of the paste binder contained in the preheating tank, sufficient flowability and tackiness are sustained in the sand containing only very small volume of water, resulting in shortening of sand drying time. In the examples above, micro wave or high frequency were used to dielectrically heat the casting mold of mixed and kneaded sand. However the preheated sand can be dried and solidified only by hot air blowing during a shaping or molding process as described as follows;

EXAMPLE 6

20% of corn starch was mixed to water and it is boiled to make starch paste. 5% in weight of the starch paste was added to No. 6 siliceous sand and kneaded. Then immediately the sand was entered to a preheating tank, in which the sand was heated to 110° C. by superheating. The preheated sand was rapidly filled into a core flask of 50 mm×50 mm to make a molding. From an end of the core flask, hot air of 200° C. was sucked in by a vacuum pump in order to rapidly dry the molding in the core flask. As shown in Table 4, the molding made by the process above is superior to the molding conventionally formed by ordinary temperature and dried in a dry furnace in strength and drying time.

Table 4

| | Ordinal temp. molding, dried in 200° C. furnace | High temp. molding, dried by 200° C. air blowing |
|---|---|---|
| Time until drying completion | 90 sec. | 5 sec. |
| pressure resistance kg/cm$^2$ | 7.1 | 14.4 |

EXAMPLE 7

20% of corn starch was mixed to 1% caustic soda solution and boiled to make paste binder. 5% in weight of the paste was added to molding sand and kneaded. The kneaded paste was entered in a preheating tank to raise paste's temperature by micro waving. The paste was rapidly filled into the core flask of 28 mm×50 mm, preventing the paste from cooling.

Table 5

| | ordinal temp. molding, dried in 200° C. air blowing | high temp. molding, dried by 200° C. air blowing |
|---|---|---|
| Time until drying completion | 9 sec. | 4 sec. |
| pressure resistance kg/cm$^2$ | 9.7 | 17.2 |

EXAMPLE 8

5% of water-soluble poval was added to water and they were sufficiently dissolved. To the resolved solution, 5% of potato starch was added and heated to make the paste. Then, 5% of the paste was added to and kneaded with No. 6 siliceous sand and the paste sand was immediately entered the preheating tank to heat it to 95° C. by high-frequency process. The hot sand was rapidly filled into a core flask sizing 28 mm×50 mm with blowing of super-heated steam in order to solidify the mold sand within a furnace of 110° C.

Table 6 below shows the drying time and the pressure resistance of the sand mold formed in an experience of the example 8. As apparently shown, in case that some synthetic resins for example water soluble poval was used, the sand mold was effectively and advantageously made by high-temperature formation process.

Table 6

| | Normal temp. molding, dried in furnace of 110° C. | High temp. molding dried in furnace of 110° C. |
|---|---|---|
| Time until drying completion | 25 sec. | 15 sec. |
| pressure resistance kg/cm$^2$ | 7 | 15 |

EXAMPLE 9

5% of starch paste containing 80% of water was added to and kneaded with mold sand. The kneaded sand was placed in a temperature sustaining and preheating tank and heated by steam to make 100° C. Rapidly the warm sand was entered to a wooden pattern flask to obtain a mold sand. The mold was at once entered to a vacuum tank along with lowering pressure therein and abruptly heated by micro-wave heating process. The drying time was advantageously shortened to five (5) seconds comparing with fifty (50) seconds according to the conventional drying method.

EXAMPLE 10

100 parts of No. 6 siliceous sand and 5 parts of starch paste containing 80% of water were mixed and kneaded to obtain mold sand which was then entered a preheating tank and heated to 100° C. by super-heated steam blowing process. The mold sand rapidly filled in a core box by super-heated steam blowing to obtain a casting mold weighed 5 kg. Immediately the mold was entered a pressure tank to which super-heated steam was supplied to heat the mold. When an inner portion or the central portion of the mold was sufficiently heated, the pressure tank is abruptly decreased in its pressure by a vacuum pump. By carrying out the abrupt pressure decreasing steps several times, the casting mold was effectively and completely dried for a very short time to its central portion and accordingly a strong and practical core was obtained.

Next, further effective another embodiment of the present invention will be decreased.

A suitable volume of water-soluble paste and 0.5 to 3.0% of water at the rate for the whole or resultant volume of both the materials were mixed and kneaded, and the mold sand was entered a sealed heating tank provided with a stirrer in order to preheat it to about 95° C. The hot mold sand was rapidly filled or charged in the mold under negative pressure of about 0.1 atmosphere in order to dry and solidify it. Hereupon, the volume of the binder paste was decided according to the kind of the water-soluble paste binder so as to effectively exibit the function or tackiness of the water-soluble paste practically, the preferable volume of the water in the paste binder was from 0.5% to 3.0% in proportion to the volume of the molding sand. When the water in the binder is smaller tha 0.5%, the tackiness is very poor and when larger than 0.3%, the time necessary to dry and solidify the paste mixed sand is made very long.

In general, in case that smaller volume of water is contained in the paste binder, fluidity of the paste, accordingly of the sand mixed with the paste and tackiness of the paste are made insufficient and thus the formability of the mold is made poor. However, according to the present invention, smaller volume of water is sufficient in the paste, because that the mixed and kneaded sand is preheated to a proper temperature. Practically, in order to obtain the warm sand containing a fixed volume respectively of water-soluble paste, water and the molding sand, the molding sand is preheated and then the binder and water are added, and while the molding sand and the binder are mixed and water is added to the mixture and then the mixture is preheated and stored. If necessary, materials such as bentonite may be added to the water-soluble paste binder. Taking economy into consideration of a vacuum pump to be used to make a negative pressure condition in the mold shaping box, about 0.1 atmosphere is practical and if rather large equipment is employed, more high degree of vacuum may be used.

In short, the suitable volume of the binder paste, water, the suitable preheating temperature and vacuum degree are decided under consideration of the necessary drying time of the sand and the economy of various factors.

According to one of the embodiments of the present invention, 100 parts of No. 6 siliceous sand, two parts of dextrin, and 1.5 parts of water are mixed and kneaded, the resultant molding sand is entered a sealed preheating tank having a stirrer plate to uniformally heat the sand at 95° C. The sand is rapidly filled to a cylindrical wooden pattern of a diameter: 300 mm and a depth: 150 mm and the sand was pressed. Next, the pressed sand is entered a reduced pressure tank to gradually decrease the inner pressure to 40 mm Hg for three minutes and a casting mold resisting to a high pressure: 35 kg/cm$^2$ is obtained.

If necessary in order to increase the pressure resistance of the dried and solidified casting mold, 2 to 10% of phenol resin dissolved in organic solvent such as alchohol is sprayed or brushed on the surface of the mold. The casting mold is dried and solidified for a very short time, so that the drying and solidifying process is completely synchronized to other process of the whole casting system.

The practical and effective preheating apparatus for molding sand according to the present invention will be described with reference to FIGS. 4 and 5.

Figure 5:
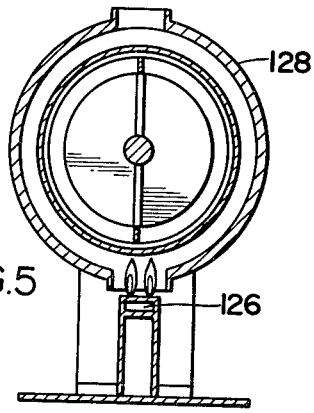
FIG. 5 is a sectional view taken along line: A—A of FIG. 4.
Figure 4:
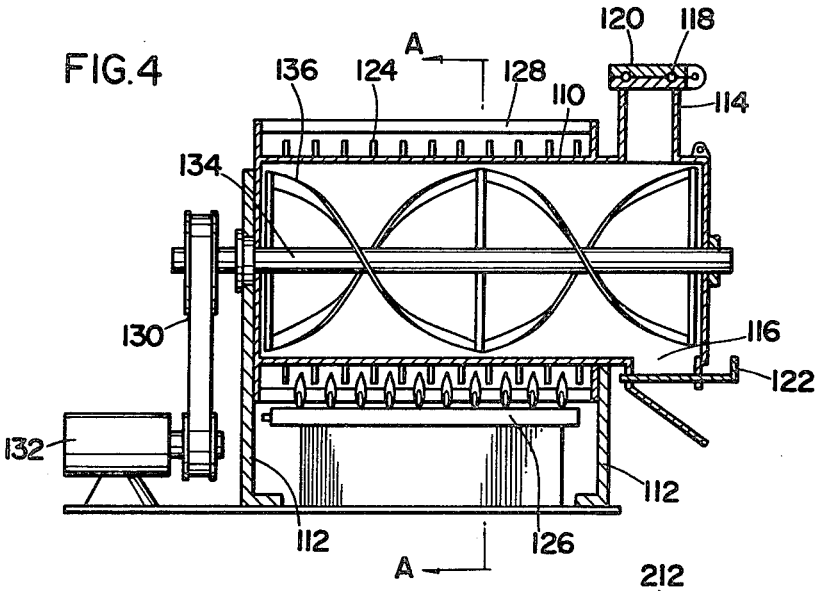
FIG. 4 is a longitudinal sectional view of molding sand preheating apparatus.

As shown in FIGS. 4 and 5, a cylindrical sealed tank 110 is horizontally arranged on a surface by a supporting leg 112 fixed to the tank. The tank has an upper sand inlet 114 and a lower sand outlet 116 respectively formed therein. There is a open-and-close lid 120 on the sand inlet 114 through an O-ring 118. A slide plate 122 for closing and opening the sand outlet 116 is equipped to the outlet. Around the outer surface of the cylindrical tank 110, there are many fins 124 in order to increase the heat transfer area. A gas burner 126 is placed under the cylindrical tank 110 so as to extend along the longitudinal axis of the tank 110. In order to increase the thermal efficiency of the gas energy, a hood 128 extend around the cylindrical tank, leaving a circular space as shown in FIG. 5. An top opening and a bottom opening are so formed on the hood 128 as to extend along the longitudinal direction of the tank, so that hot air flows upwards within the circular space from the gas burner to the top opening. A rotary shaft 134 extends within the cylindrical tank 110 at its center, which is driven by a driving motor 132 through a pulley 130. The rotary shaft 134 has a ribbon screw for stirring the molding sand and it is fixed thereon so as to slide along the inner surface of the tank.

The sand and binder previously mixed and kneaded are supplied to the preheating tank 110 through the sand inlet 114. After closing of the lid 120, a burning by the gas burner 126 and a sand stirring by the ribbon screw 136 are simultaneously carried out in the tank. When the temperature of the stirring reaches about 90° C. to 100° C., the slide plate 122 is opened to transfer the hot sand from the tank 110 to a heat insulator tank (not shown). If necessary, the sand may be preheated to lower than 90° C.

The mixed kneaded and preheated sand is then rapidly filled to a molding flask wherein the sand is exposed to a hot air blowing and/or a negative pressure in order to instantaneously dry and solidify the molding sand.

The apparatus for effectively molding cores will be described with reference to FIG. 6.

Figure 6:
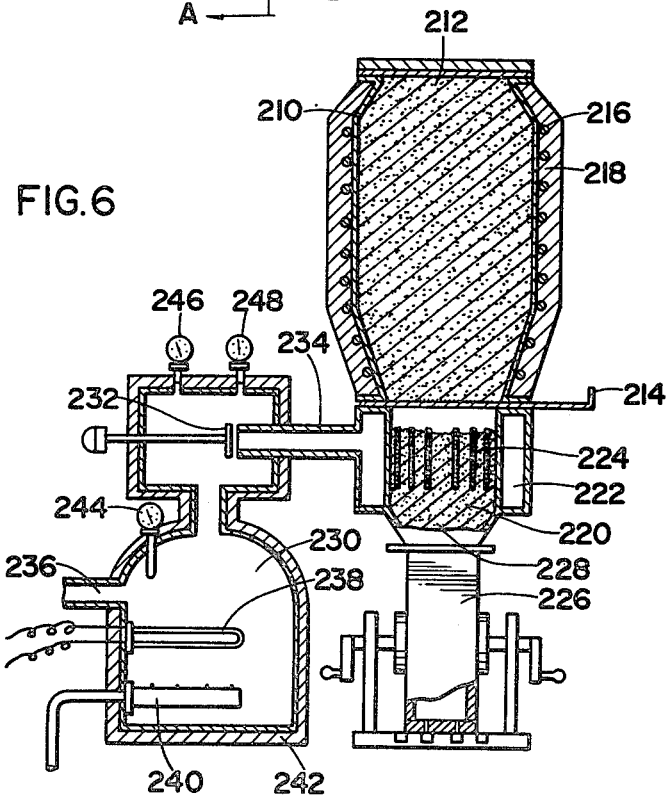
FIG. 6 is a sectional view of core molding apparatus.

As shown in FIG. 6 a sand keeping tank 210 stores the molding sand preheated by a sealed type agitating and preheating device. The sand is supplied to the sand keeping tank 210 through a sand inlet 212 formed at the top of the tank 210. The sand within the tank is warmed by a heat generating means such as an electric heater 216 buried into a heat insulating wall 218 applied around the outerwall of the tank. By employing the construction above to the tank, the preheated sand is effectively stored without loss of thermal energy. The sand stored within the tank is downed to a molding core flask through a blowing-in room 220 when a partition 214 is opened operatively mounted at the bottom of the tank. The blowing-in room 220 has a double-wall construction at its circumference. The outer and inner walls construct an air room 222 between them as shown and the inner wall has a number of slits 224 connecting the air room 222 to the blowing-in room 220.

The sand is supplied to the molding core flask 226 through a sand supply port 228. Air blowing is supplied into the blowing-in room 220 from the air tank 230 through an opening valve 232 and an air duct 234. The air tank 230 contains air of high-pressure, high temperature and high-humidity. The high-pressure is given to the air in the tank 230 by an air compressor (not shown) connected to the tank 230 through an air duct 236. The air in the tank 230 is heated by an electric heater 238 and a super-heated steam supply pipe 240 respectively placed within the tank 230. The warmness of the air in the tank 230 is prevented from escaping by means of a thermal insulating material 242 bonded around the tank. The temperature, humidity and pressure are monitored by a thermometer 246, a hygrometer 244 and a manometer 248 in order to freely control them.

In operation, the molding sand containing a binder of water-soluble paste is stored within the sand keeping tank 210 in order to keep the water content and temperature of the sand constant. Then, the molding core flask 226 is applied or connected to the sand supply port 228 and the partition 214 is opened in order to drop a fixed volume of the mixed and kneaded sand from the sand keeping tank 210 to the blowing-in room 220. The opening valve 232 is opened in order to supply the air contained under pressure in the air tank 230 to the blowing-in room 220 through the air duct 234, the air room 222 and the slits 224, so that the heated sand is rapidly supplied to the molding core flask or box 226 through the sand supply port 228.

The condition of the air contained in the air tank 230 is decided according to the condition of the heated sand to be supplied to the molding core flask 226. In detail, the temperature and humidity of the tank air is controlled according to the water content of the sand and the paste and when the sand contains little water content, cold air is supplied to the sand and on the contrary when the sand contains large water content, air of low humidity or dry air is supplied to the wet sand. The sand charged in the molding core flask 226 is cooled, being compressed or sucked, in order to rapidly dried and solidified.

According to the preferred example of the invention, 100 parts of No. 6 siliceous sand, 2 parts of water, and 2.5% of dextrin were mixed and kneaded and preheated to 95° C. in a preheater mill. The preheated sand was entered a store tank in order to prevent water content from evaporating, keeping the temperature of the sand at about 95° C. A necessary amount of the sand was transferred to the blowing-in room and immediately the sand was blown into the molding core flask by a hot air flowing of five atmosphere 100° C. and a humidity of 100%. The size of the molding core flask was a diameter of 100 cm, a length of 10 cm. Then, a dry air of 200° C. under two atmosphere was pressed into the flask for 45 seconds and as a result a completely dried and strong core was obtained by using the core, excellent castings were produced.

Figure 7:
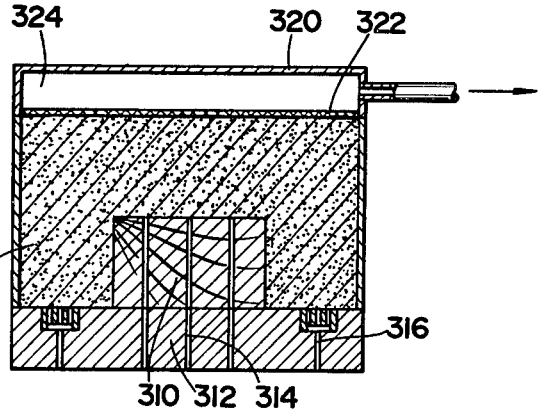
FIGS. 7 and 8 are sectional view of molding flasks.

As shown in FIG. 7, a pattern 310 is placed on a pattern stand 312 and a suitable number of air vent are formed in the pattern and the stand. The air vents connect the molding sand 326 around the pattern 310 and the atmospheric air. The diameter of the vent is decided with reference to the size of molding sand and the preferable diameter of vent is about 0.5 to 2 mm. Other air vents for connecting the molding sand and the atmospheric air through only the pattern stand 312 are provided in the stand. The molding sand is enclosed or sealed by a molding flask 320 mounted on the pattern stand 312. A wire net 322 is extended horizontally as shown at the upper portion of an inner space of the molding flask 320. The space surrounded by the top wall of the molding flask 320 and the wire net 322 is called a negative pressure room 324, to which the molding sand 326 is sucked.

The molding sand which includes an water-soluble paste binder and is preheated at 50° C. to 100° C. was poured or blown into the molding flask 320, the air within the negative pressure room 324 was sucked by a vacuum pump (not shown) through a pipe opened to the room 324, and as a result, the atmospheric air was sucked up through air vents 314 and 316. Thereofre, the molding sand was gradually dried and solidified, starting from the surrounded sand contacted with the pattern to the central portion of the molding sand.

When the dried and solidified layer was produced around the pattern, the pattern was removed. By additionally air-sucking the molding sand through the wire net, the air was freely sucked and flown through the vacant space of removed pattern in order to further solidify the whole molding sand in the flask 320.

Figure 8:
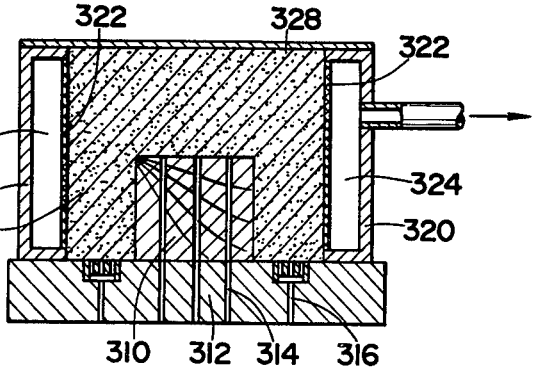

As shown in FIG. 8 of another embodiment of the molding core flask according to the present invention, the molding sand was surrounded by vacuum room 324 placed at its sides through wire nets 322 and by a resin film 328 placed at its top.

Figure 9:
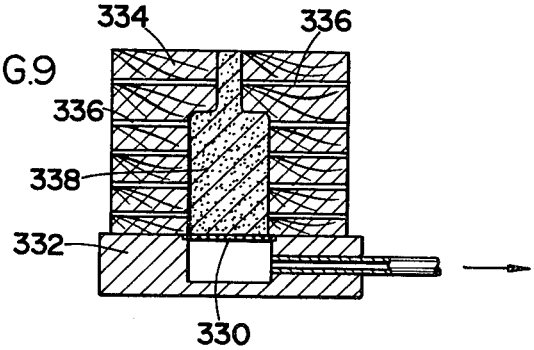
FIG. 9 is a sectional view of core molding.

According to still another embodiment of the present invention shown in FIG. 9 the negative pressure room is formed in the pattern stand 332, a wire net 330 is extended to define the upper surface of the negative pressure room, and a molding core flask 334 stands on the stand 332. A number of air vents 336 are formed in the flask 334 so as to open in the atmospheric air. In operation, the molding sand is poured into the molding core flask and the air in the sand is sucked through the wire net 330 in order to rapidly dry and solidify the molding sand making at first a thin layer sand 338 surrounding the pattern.

As soon as the sand layer 338 is solidified, the core flask 334 can be removed and immediately reused to another core flask.

EXAMPLE 11

50 kg of No. 5 siliceous sand was heated in a heating vessel to 110° C. The hot sand was entered a sealed agitator mill to which 1 kg of dextrin and 1.5 kg of hot water at 95° C. are added. The sand added with dextrin and hot water was kneaded for 10 minutes to obtain warm molding sand. 20 kg of the molding sand preheated at 85° C. was poured or blown into a molding flask having a number of air vents therein and a mold releasing agent applied to the core flask. Then, a negative pressure room was placed on the flask containing the molding sand in order to suck the sand at a pressure of 400 mmHg for 20 seconds, obtaining as a result moldings uniformly dried and solidified to its depth.

EXAMPLE 12

50 kg of dried No. 6 siliceous sand was preheated to 110° C. in a heating and strring mill. 2 kg of dextrin and 2 kg of hot water at 95° C. were added to the hot sand and it was agitated for ten minutes. 20 kg of the hot molding sand was poured into the molding flask shown in FIG. 8, sucking the sand through the sided negative pressure room. As a result, the pattern 310 was freely released from the molding sand within thirty (30) seconds and time of 15 minutes was found sufficient to completely dry and solidify the whole molding sand.

Figure 10:
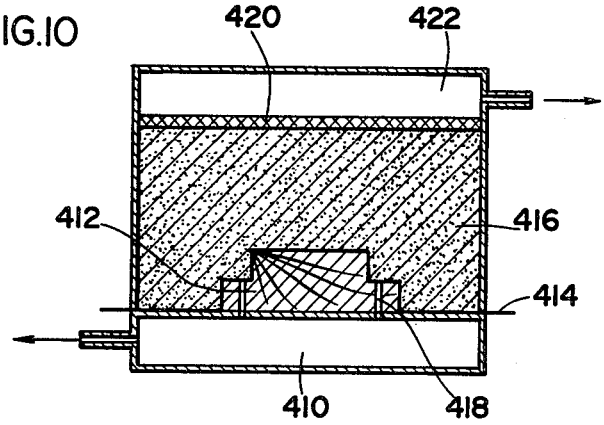
FIG. 10 is a sectional view showing a wooden pattern and molding sand sandwiching a mold releasing layer between them.
Figure 11:
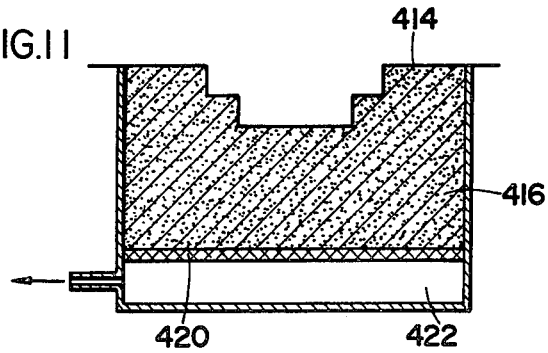
FIG. 11 is a sectional explanatory view of the turnovered casting mold, from which the pattern is removed.

Another embodiment of the molding core flask for carrying out the present invention will be descided with reference to FIGS. 10 and 11.

As shown in FIG. 10, a negative pressure room or stand 410 operatively connected to a vacuum device has a wooden pattern 412 thereon. The sand is poured into the molding flask and filled around the pattern 412 through a mold releasing layer 414 such as a resin film or synthetic rubber film. When the air within the negative pressure room 410 is sucked through air vents 418 provided in the pattern 412, the mold releasing layer 414 is made closely contact with the upper surfaces of the pattern and the room 410. Preferably, the molding sand to be filled in the flask contains a water-soluble paste binder and preheated at 40° C. to 90° C. After a completion of the filling of the molding sand, another vacuum room 422 provided with a wire net 420 at its bottom is placed on the molding flask so as to contact the molding sand 416 with a bottom face of the wire net 420. Then, a suction of the negative pressure room 422 starts. After a completion of the suction, the function of the vacuum room 422 is stopped and the assembly of the rooms, the molding sand and the pattern is turned upside down as shown in FIG. 11 in order to separate the pattern from the sand. Because that there is no tackiness between the layer 414 and the pattern 412, the pattern is easily removed.

During the room 422 is situated at its negative pressure condition, hot air is sprayed at the layer 414 to melt it and passed to the room 422 through the molding sand 416. Thus, the snad is rapidly dried and solidified from a sand portion contacting the plastic layer 414 in order to make a solid sand layer conforming the pattern 412 for a very short time. In case that the mold is rather small, there is no need to spray hot air at the plastic layer 414 and it is sufficient to remove only the plastic layer 414.

EXAMPLE 13

A plastic film was covered upon a pattern sizing a diameter of 150 mm and a length of 150 mm. The pattern was placed in a molding flask. 100 parts of No. 6 siliceous sand, one part of dextrin and 0.8 part water were mixed, kneaded and preheated at 90° C. The molding sand was filled in the molding flask and the negative pressure room 422 was placed on the flask. Low pressure of 650 mmHg is applied to the room 422 and the room and the flask were turned upside down to remove the pattern. Hot air of 300° C. was sprayed to the plastic layer to melt it and, after the completion of the melting an operation of suction and spraying was continued for five (5) minutes to completely dry and solidify the molding sand. Thus, the outer surface of the mold was made solid by combining of molten plastics and dextrin.

According to a conventional decompression molding process, the molding sand is sealed by a film after its formation to sustain the formed molding sand under negative pressure. Therefore, if the film is broken during a suction process, the sand disadvantageously is not sustained under negative pressure and at its formed condition. The merit of both the conventional decompression molding process and also the present invention is that the formed molding sand is easily broken after a casting process. The demerit of the conventional process is to need to continue the vacuum suction operation in order to sustain the formation of molding sand. On the contrary, the sand molds of the present invention can be transferred and piled up after their solidification, so that housewere space being used to store the molds is exceedly reduced.

It should be fully appreciated that the above examples are given by way of illustration of the present invention and are not intended to limit in any way the scope of the subjoined claims.

What is claimed is:

1. A mold manufacturing process including the steps of:

mixing and kneading 100 parts by weight of molding sand, and 0.5 to 5 parts by weight of a water soluable binder and 1 to 5 parts by weight of water;

heating the aforesaid mixture to a temperature between 60° and 140° C.;

molding said mixture in its heated condition into a mold;

generating and supplying an air stream through the sand molded; and, removing the water from the sand molded to dry and harden the sand molded.

2. The process as claimed in claim 1, including the step of:

coating the molding sand with the water-soluable binder.

* * * * *